US009801768B2

(12) United States Patent
Wong

(10) Patent No.: US 9,801,768 B2
(45) Date of Patent: Oct. 31, 2017

(54) MANUAL LIFTING SLING APPARATUS

(71) Applicant: U.S. Pacific Nonwovens Industry Limited, Kowloon (HK)

(72) Inventor: Cho Kee Wong, Kowloon (HK)

(73) Assignee: U.S. PACIFIC NONWOVENS INDUSTRY LIMITED, Kowloon (HK)

( * ) Notice: Subject to any disclaimer, the term of this patent is extended or adjusted under 35 U.S.C. 154(b) by 0 days.

(21) Appl. No.: 14/654,765

(22) PCT Filed: Feb. 18, 2013

(86) PCT No.: PCT/CN2013/071651
§ 371 (c)(1),
(2) Date: Jun. 22, 2015

(87) PCT Pub. No.: WO2014/124565
PCT Pub. Date: Aug. 21, 2014

(65) Prior Publication Data
US 2015/0342811 A1 Dec. 3, 2015

(51) Int. Cl.
*A61G 7/14* (2006.01)
*A61G 7/10* (2006.01)

(52) U.S. Cl.
CPC ..... *A61G 7/1023* (2013.01); *A61G 7/1038* (2013.01); *A61G 7/1063* (2013.01); *A61G 2203/90* (2013.01); *A61G 2205/30* (2013.01)

(58) Field of Classification Search
CPC ..... A61G 7/14
(Continued)

(56) References Cited

U.S. PATENT DOCUMENTS 5,056,533 A * 10/1991 Solano ..... A47D 15/006 128/876
5,333,335 A * 8/1994 Gastle ..... A61G 1/01 5/625

(Continued)

FOREIGN PATENT DOCUMENTS

CN 102727355 A 10/2012
CN 103083138 A 5/2013

OTHER PUBLICATIONS

International Search Report issued in corresponding International Application No. PCT/CN2013/071651, dated Dec. 5, 2013, 6 pages (with translation).

(Continued)

*Primary Examiner* — Fredrick Conley

(57) ABSTRACT

Disclosed is a manual lifting sling apparatus (10) made of fabric, comprising: a bottom support part (12) used for supporting the buttocks and legs of a patient; a rear support part (11) joined to the bottom support part (12) to form an inclined angle and used for supporting the back of the patient; a left blocking part (13) and a right blocking part (14) restraining the patient respectively on the left and right sides, the left blocking part (13) and the right blocking part (14) both concurrently being joined with the bottom support part (12) and the rear support part (11); and at least two lifting handles (15) provided on both the left blocking part (13) and the right blocking part (14). The fabric used for the apparatus is a woven fabric or non-woven fabric, and is made of a non-biodegradable material or biodegradable polymer material. The apparatus has a simple structure, a rational design, a high degree of comfort and is low in cost, and can be a manual lifting sling apparatus deployed specially for each patient for finite use.

12 Claims, 2 Drawing Sheets

(58) Field of Classification Search
USPC ..... 5/81.1 T, 81.1 R
See application file for complete search history.

(56) References Cited

U.S. PATENT DOCUMENTS

| | | | | |
|---|---|---|---|---|
| 5,579,543 | A * | 12/1996 | Crawford | A61G 7/0005 4/540 |
| 6,341,393 | B1 * | 1/2002 | Votel | A61G 7/1019 5/484 |
| 2001/0049243 | A1 * | 12/2001 | Crouch | B29C 33/58 442/76 |
| 2005/0283907 | A1 | 12/2005 | Dalton | |
| 2009/0113623 | A1 | 5/2009 | Thomas et al. | |
| 2012/0053545 | A1 * | 3/2012 | Love | A61F 5/48 604/365 |

OTHER PUBLICATIONS

Written Opinion of the International Searching Authority issued in corresponding International Application No. PCT/CN2013/071651, dated Dec. 5, 2013, 10 pages (with translation).

* cited by examiner

MANUAL LIFTING SLING APPARATUS

FIELD OF THE INVENTION

The present invention relates to lifting devices, more particularly, relates to a manual lifting sling apparatus.

BACKGROUND OF THE INVENTION

Lifting slings are always used to transport patients or disabled people. The critical issue in using lifting slings is how to prevent accident and cross-infection between patients. The earliest lifting sling is made of woven fabrics, which has complex structure and unreasonable design thus improving the cost of the product.

The lifting slings should be re-used because of the problem of the cost, easily leading to cross-infection. In the process of washing the slings made of woven fabrics, it is not possible to kill all organisms that may lead to infection, especially when washing at a temperature that the slings can bear. If the woven slings are washed or dried at a temperature higher than that the slings could bear even to kill all infective organisms, the slings will be destroyed. It is also possible for the slings to be lost or destroyed when transported between the using spot and the washing spot, so it is necessary to prepare sufficient spare slings to be provided to patients when some slings are being washed or transported. Based on the bad effects resulting from these, slings are forbidden in some hospitals. Reducing the cost of the lifting slings will be beneficial for proposing the disposable or limited-used lifting slings, solving the problem of cross-infection between patients. Thus, it is an urgent problem that how to develop a lifting sling with reasonable design and low cost effectively at present.

SUMMARY OF THE INVENTION

The objective of the present invention is to provide a manual lifting sling apparatus, aiming at the above-mentioned drawbacks that the ordinary lifting slings are with complex structures and high costs.

The technical solutions of the present invention for solving the technical problems are as follows: a manual lifting sling apparatus is provided, it comprises following portions made of fabric:

a bottom support part used to support the buttocks and the legs of a patient;

a rear support part used to support the back of the patient, connected to the bottom support part in a sloping angle;

a left blocking part and a right blocking part used to refine the patient at the left side and the right side respectively, the left blocking part and the right blocking part are connected with the bottom support part and the rear support part at the same time, and at least two lifting handles are provided on each of the left blocking part and the right blocking part.

In the manual lifting sling apparatus, the fabric may be woven fabric or nonwoven fabric.

In the manual lifting sling apparatus, the edges of the bottom support part, the rear support part, the left blocking part and the right blocking part are padded and/or reinforced and seamed to one piece.

In the manual lifting sling apparatus, the bottom support part and the rear support part are cut to conform to the body shape of the person and provided with wrinkles.

In the manual lifting sling apparatus, the fabric is provided with a label.

In the manual lifting sling apparatus, the fabric is made of one or more layers of woven or nonwoven film.

In the manual lifting sling apparatus, a breathable non-biodegradable or biodegradable film is adhered to one or both faces of the fabric of the manual lifting sling apparatus.

In the manual lifting sling apparatus, the fabric is made of non-biodegradable materials comprising PP, PE, PET or PA.

In the manual lifting sling apparatus, the fabric is made of biodegradable materials comprising PLA, PHA, PHA, PBAT, PBS, PHB or blends of some of them.

In the manual lifting sling apparatus, the fabric is made of heat bonded randomly oriented non-biodegradable or biodegradable fibers.

In the manual lifting sling apparatus, the fabric is made of hydroentangling or needlepunching continuous filament or staple fiber webs.

In the manual lifting sling apparatus, the fabric is made of webs of continuous filaments or staple fibers bonded with non-biodegradable or biodegradable chemicals comprising latex binders or adhesives.

A method of preventing cross-infection between lifted patients is also provided, each patient has his/her own dedicated manual lifting sling apparatus described above.

When implementing the present invention, the following advantageous effects can be achieved: the manual lifting sling apparatus provided in the present invention has simple structure, reasonable design high comfort and low cost, which may enable each patient to be equipped with a dedicated manual lifting sling apparatus to be used only limited times.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the objects, technical schemes and advantages more clearly, the present invention may be further described in detail with reference to the accompanying drawings and embodiments.

The present invention relates to a manual lifting sling apparatus used to support the body of the patient to be lifted manually. In some cases, this kind of manual lifting sling apparatus can be used as a stretcher. The terms "manual lifting sling apparatus", "sling", "lifting sling" and "stretcher" are used interchangeably in this description. The same device may be referred to as either a lifting sling or as a stretcher depending on its use and on the terminology most frequently used by the care givers or patient movers. For example if the device is used to transport an injured person from an accident scene to a nearby ambulance, it may be referred to as a stretcher, but if later the patient is moved to or from a bed or to another location in the hospital, the same device may be referred to as a lifting sling.

According to the present invention there is provided a method of preventing cross-infection between patients lifted in non-biodegradable or biodegradable manual lifting sling apparatuses or stretchers hoisted by two people, where each patient has his/her own dedicated manual lifting sling apparatus. Preferably, each lifting sling is clearly marked to identify the patient for whom the sling is intended. The lifting slings can be marked with indelible ink to ensure they are not used for other persons. Further, the fabrics in the lifting slings can be made of biodegradable polymers. It has been found that such biodegradable nonwoven slings can be made at a fraction of the cost of woven materials and will withstand the forces applied to them. It is therefore possible to dedicate slings to individual persons so as to prevent cross-infection between patients, and in the meanwhile, as the fabrics in the manual lifting sling apparatuses are biodegradable and/or compostable, it is possible for the discarded slings to dispose in a manner that is not harmful to the environment.

Figure 1:
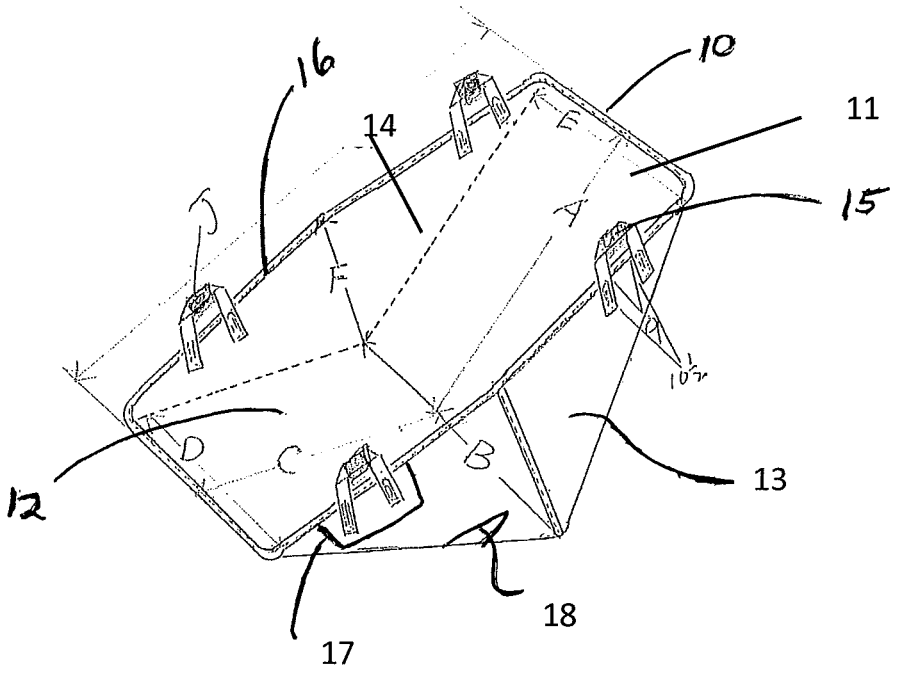
FIG. 1 is a perspective view of a manual lifting sling apparatus according to a preferred embodiment of the present invention.

FIG. 1 is a perspective view of a manual lifting sling apparatus according to a preferred embodiment of the present invention. Referring to FIG. 1, a manual lifting sling apparatus 10 has been shown, comprising following portions made of fabric: a bottom support part 12, a rear support part 11, a left blocking part 13 and a right blocking part. The bottom support part 12 is positioned at the bottom to support the buttocks and legs of a patient. The rear support part 11 is tilted relative to the bottom support part 12 in a certain angle to support the back of the patient. The lower end of the rear support part 11 is jointed to the rear end of the bottom support part 12, and preferably, the tilted angle is an obtuse angle, comfortable for the patient sitting in the manual lifting sling apparatus 10. Preferably, the rear support part 11 and the bottom support part 12 are isosceles trapezoids, two longer bases of which are jointed together.

The left blocking part 13 and the right blocking part 14 are used to refine the patient at the left side and the right side respectively. The left blocking part 13 and the right blocking part 14 are connected with the bottom support part 12 and the rear support part 11 at the same time. In some embodiments, the left blocking part 13 is substantially a triangle, one base of which is connected to the left waist of the bottom support part 12, the other base of which is connected to the left waist of the rear support part 11. Correspondingly, the right blocking part 14 is set in the similar manner. In other embodiments, referring to FIG. 1, the left blocking part 13 comprises two triangles connected to the bottom support part 12 or the rear support part 11 respectively to enlarge the space surrounded by the manual lifting sling apparatus 10. The manual lifting sling apparatus 10 is symmetric to the central axis plane.

At least two lifting handles 15 are provided on each of the left blocking part 13 and the right blocking part 14. In the embodiment for example, a lifting handle 15 is provided both on the upper side and the lower side of the left blocking part 13 to exert itself to the back region and the leg region of the patient. Of course, two lifting handles 15 are provided on the right blocking part 14 in the same manner.

Preferably, the edges of the bottom support part 12, the rear support part 11, the left blocking part 13 and the right blocking part 14 are folded and/or reinforced and seamed to one piece. For example, the edge 16 is folded several times and seamed with thread or ultrasonically bonded. Preferably, the bottom support part 12 and the rear support part 11 are cut to conform the body shape of a person, for example, provided with wrinkles 18. In the region 17 that provided with the lifting handle 15, it is reinforced such as thickened, extrusion coated with a fabric film.

Besides, a label can be provided on the fabric of the manual lifting sling apparatus 10. For example, a label can be sewn onto it or some words can be written onto it through a Persistent ink pen. For example, at the top of the label are universally the patient's name or recognized symbols signifying "do not wash," "do not iron," and "do not tumble dry."

Figure 2:
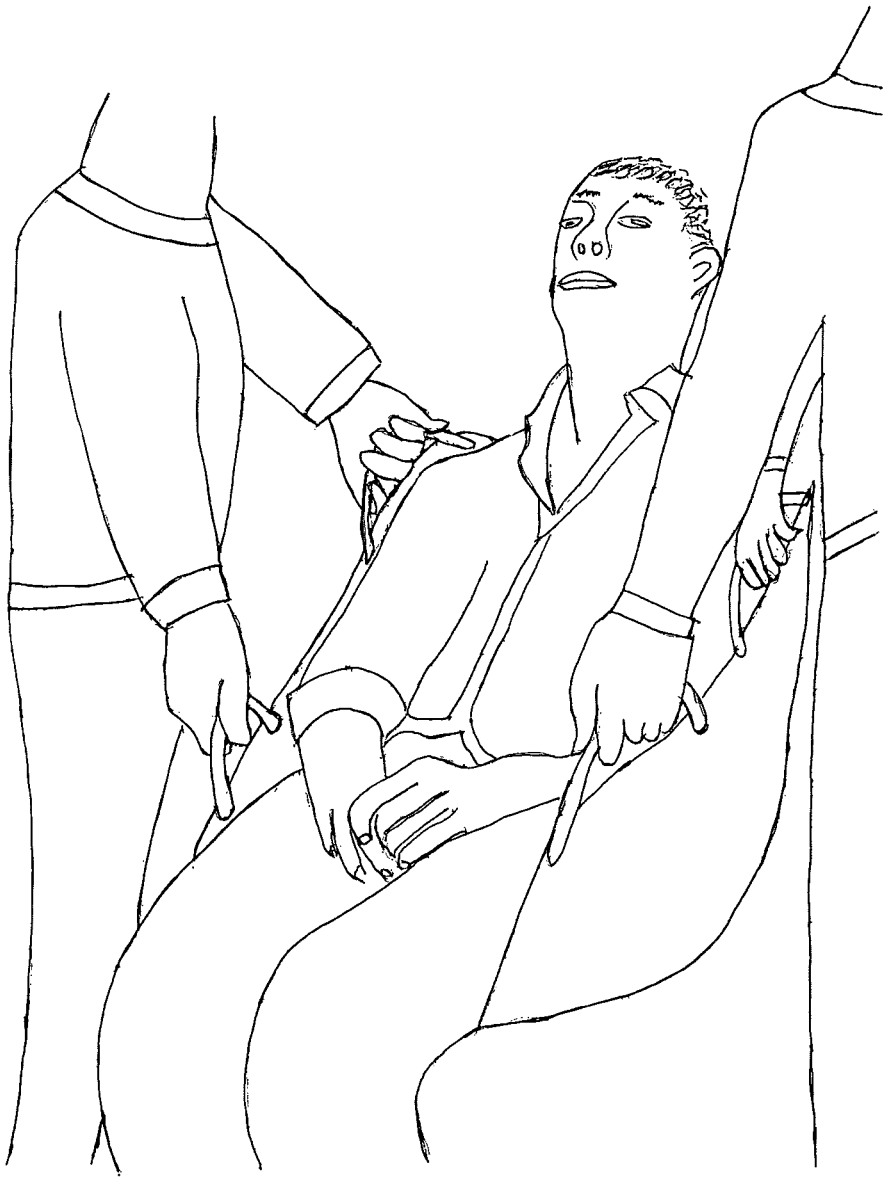
FIG. 2 is a view of a manual lifting sling apparatus in use according to a preferred embodiment of the present invention.

Referring to FIG. 2, which is a view of a manual lifting sling apparatus in use according to a preferred embodiment of the present invention, a patient can sit into the space surrounded by the manual lifting sling apparatus which supports the back, buttock and legs of a patient, being hand-hoisted and carried by two people, with a person holding two lifting handles on each side of the sling, with one handle on each side supporting the back of the patient and the other handle on that side supporting the buttock and legs of the seated hoisted patient.

The present invention may be made of woven fabric or nonwoven fabric, preferably made of nonwoven fabric. The nonwoven fabric can be provided with an embossed pattern by rolling (calendering) to give it the appearance of a woven fabric. The sling 10 may be reinforced by an additional layer of fabric. The manual lifting sling apparatus of the present invention has been subjected to fifty lifts lifting 190 kg and has withstood this test without any sign of weakening, although the recommended safety weight load is 120 kg.

Besides, the fabric may be made of one or more layers of woven or nonwoven film. It may also have a breathable or non-breathable film laminated to either or both sides of the biodegradable nonwoven fabric of the sling to contain any body fluids of the patient during lifting and transport.

The manual lifting sling apparatus of the present invention is made of non-biodegradable fabrics comprising PP, PE, PET or PA and other man-made polymers.

Preferably, the manual lifting sling apparatus of the present invention is made of nonwoven biodegradable/compostable polymeric material. Biodegradable polymers are typically PLA or blends of a major portion of PLA and a minor portion of PHA or of a major portion of PLA and minor portions of PHA and PBAT or of a major portion of PLA and minor portions of PHA, PBAT and PBS or of a major portion of PLA and minor portions of PBAT and PBS or of blends of PBAT and PBS or of a major portion of PLA and a minor portion of PHB.

Typically, the sling is made by heat bonding randomly oriented non-biodegradable or biodegradable/compostable polymer fibers, but it could be made of drylaid, chemically bonded (with biodegradable adhesive) fabric or of drylaid, spunlace (hydroentangled) fabric. This material does breathe (unless a non-breathable biodegradable film is adhered to it) but does not pass water and it may necessary to provide perforations in the sling if it is to be used for lowering invalids into a bath. The fabric can be made of hydroentangling or needlepunching continuous filament or staple fiber webs. The fabric can be made of webs of continuous filaments or staple fibers bonded with non-biodegradable or biodegradable chemicals comprising latex binders or adhesives.

In order to prevent the discarded manual lifting sling apparatuses make bad effect on the environment, the fabric in the manual lifting sling apparatus can be made from biodegradable and/or compostable fabrics. The biodegradable and/or compostable fabrics will be discussed below. The biodegradable materials used in the present invention can ensure the corresponding carrying ability of the sling to avoid accidents in lifting; at the same time, the manufacturing cost will not be increased so that the patients can afford the dedicated lifting slings to avoid cross-infection.

Among the common biodegradable polymers today, the advantage of the polylactic acid (PLA) as biodegradable/compostable polymer for plastics and fibers is that although it is derived from natural, renewable materials, it is also thermoplastic and can be melt extruded to produce plastic items, fibers and fabrics with good mechanical strength, toughness, and pliability comparable to similar materials produced from a wide range of oil-based synthetics such as polyolefins (polyethylene and polypropylene) and polyesters (polyethylene terephthalate and polybutylene terephthalate). PLA is made from lactic acid, a fermentation byproduct derived from corn (*Zea mays*), wheat (*Triticum* spp.), rice (*Oryza sativa*), or sugar beets (*Beta vulgaris*). When polymerized, the lactic acid forms an aliphatic polyester with the dimmer repeat unit shown below:

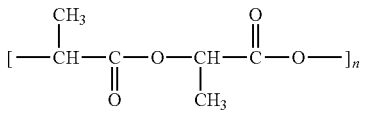

(1)

Poly(hydroxyalkonate)s [PHAs] have been found to be naturally synthesized by a variety of bacteria as an intracellular storage material of carbon and energy. The Copolyester Repeat Unit of P(3HB-co-4HB) of P(3HB-co-4HB) is as follows:

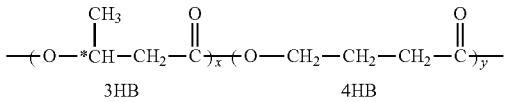

(2)

Polybutylene adipate terephthalate (PBAT) is a biodegradable polymer which is not currently produced from a bacteria source, but is synthesized from oil-based products. Although PBAT has a melting point of 120° C., which is lower than PLA, it has higher flexibility, excellent impact strength, and good melt processibility. Even though PLA has good melt processing, strength, and biodegradation/composting properties, it has low flexibility and low impact strength. Blending PBAT with PLA improves the end-product flexibility, pliability and impact strength. The chemical structure of PBAT is shown below:

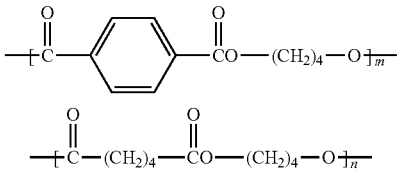

(3)

Poly(butylene succinate) (PBS) are synthesized by the polycondensation reactions of glycols. The chemical structure of PBS is shown below:

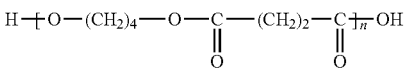

(4)

Although the biodegradation of P(3HB-co-4HB) products have been shown to readily occur in soil, sludge, and sea water, the rate of biodegradation in water in the absence of microorganisms is very slow (Saito, Yuji, Shigeo Nakamura, Masaya Hiramitsu and Yoshiharu Doi, "Microbial Synthesis and Properties of Poly(3-hydroxybutyrate-co-4-hydroxybutyrate)," Polymer International 39 (1996), 169-174). Thus the shelf life of P(3HB-co-4HB) products in clean environments such as dry storage in sealed packages, in clean wipes cleansing solution, etc should be very good. However when placed in dirty environments containing microorganisms such as soil, river water, river mud, sea water, and composts of manure and sand, sludge and sea water, the disposed P(3HB-co-4HB) fabrics, films and packaging materials should readily degrade. It should be noted that polylactic acid (PLA) is not considered to be readily biodegradable in the above dirty environments and ambient temperature, but must be composted. First the heat and moisture in the compost pile must break the PLA polymer into smaller polymer chains and finally to lactic acid. Then microorganisms in the compost and soil consume the smaller polymer fragments and lactic acid as nutrients. Thus the mixing of polyhydroxyalkonates (PHAs) as such as P(3HB-co-4HB) with PLA should enhance the biodegradation of products made from blends of PHAs-PLA. Furthermore, products made from blends of PHAs and PLA should have enhanced shelf-life in clean environments. However, the price of PLA has decreased substantially over the past 10 years to just a little more than synthetic polymers such as polypropylene and PET polyester; whereas, the price of PHAs will likely remain two to three times higher than PLA which is synthesized on a large scale from lactic acid. PHAs are produced by bacteria with specific carbon sources, and have to be extracted from the bacteria with a solvent. Thus it may not be commercially feasible to mix more than 25% PHA with PLA to melt extrude products such as fibers of woven, knitted and nonwoven fabrics, films, food packaging containers, etc.

Examples of biodegradable nonwoven fabric, biodegradable films, and nonwovens laminated with biodegradable films are shown in Table 1. Pure PBAT film with a thickness of 9 micron (μm) and 9 μm PBAT film with 20% calcium carbonate were obtained from a vendor in China. Meltblown (MB) Vistamaxx® (not biodegradable) containing 20% PP (not biodegradable) was obtained from the Biax-Fiberfilm Corporation in Neenah, Wis., USA. Spunbond (SB) PLA pigmented black with carbon black with a nominal weight of 80 g/m2 was obtained from the Saxon Textile Research Institute in Germany. The pure PBAT film and PBAT film with 20% calcium carbonate were laminated in separate trials to Vistamaxx MB containing 20% PP and black SB PLA using from 5-13 g/m2 of hot-melt adhesive. Generally from 0.5-12 g/m2 hot-melt adhesive and preferably from 1-7 g/m2 of hot-melt adhesive should be used. In addition, two layers of the SB PLA were laminated and adhered using hot-melt adhesive. All of the raw materials and laminates were tested as shown in Table 1 for weight, thickness, tenacity, elongation-to-break, tearing strength, bursting strength, water vapor transmission rate (WVT) and hydrohead. It should be noted that these are only some examples of the different embodiments of this invention and that in addition to using a hot-melt application to adhere the different layers of the materials below together, the PBAT films or other biodegradable/compostable films could be directly applied to the substrates by extrusion coating without necessarily requiring an adhesive. The laminate could have been joined or bonded together by thermal point calendaring, overall-calendering, or ultra-sonic welding, just to name a few. Furthermore, instead of a hot-melt adhesive, glue, or water or solvent-based adhesives or latexes could have been used to adhere the laminates together.

TABLE 1

Strength and Barrier Properties of Polymers

| Sample No./ Description | Weight $g/m^2$ | Thick mm | Tenacity N/5 cm MD | Tenacity N/5 cm CD | Elongation % MD | Elongation % CD | Tear Strength Trapzoid, N MD | Tear Strength Trapzoid, N CD | Burst Strength $KN/m^2$ | WVTR $g/m^2$ 24 hr | Hydrohead mm $H_2O$ |
|---|---|---|---|---|---|---|---|---|---|---|---|
| 1/Pure PBAT Film, 9 μm | 8.9 | 0.009 | 10.0 | 5.1 | 67.7 | 307.6 | 1.5 | 14.6 | *DNB | 3380 | 549 |
| 2/PBAT Film with 20% $CaCO_3$ | 9.3 | 0.010 | 8.9 | 4.1 | 48.1 | 296.3 | 1.8 | 8.0 | DNB | 2803 | 415 |
| 3/MB Vistamaxx & 20% PP | 42.1 | 0.229 | 17.2 | 11.6 | 304.0 | 295.8 | 16.0 | 8.6 | DNB | 8816 | 1043 |
| 4/PBAT Film + Vistamaxx | 63.9 | 0.242 | 31.4 | 16.0 | 179.5 | 390.0 | 24.6 | 8.5 | DNB | 1671 | 339 |
| 5/PBAT Film + 20% $CaCO_3$ + Vistamaxx | 65.3 | 0.249 | 25 | 17.7 | 116.6 | 541.9 | 22.0 | 10 | DNB | 1189 | 926 |
| 6/Black 80 gsm SB PLA | 81.3 | 0.580 | 102.4 | 30.7 | 3.6 | 30.7 | 6.2 | 12.0 | 177 | 8322 | 109 |
| 7/Black 80 gsm SB PLA + Pure PBAT Film | 101.3 | 0.584 | 107.0 | 39.2 | 4.6 | 9.8 | 8.5 | 20.7 | 220 | 2459 | 3115 |
| 8/Black 80 gsm SB PLA + PBAT Film-20% $CaCO_3$ | 96.5 | 0.557 | 97.0 | 36.3 | 4.9 | 8.0 | 9.3 | 19.0 | 151 | 2353 | 2600 |
| 9/2 Layers of Black SB PLA Bonded by 3 gsm hot-Melt | 183.6 | 1.060 | 215.3 | 76.8 | 4.9 | 9.4 | 14.7 | 22.5 | 503 | 7886 | 70 |

*DNB—Did not burst due to high elasticity

As shown in Table 1, the 9 μm pure (100%) PBAT film (Sample 1) had good elongation in the MD direction and very high elongation-at-break of over 300% in the CD. The bursting strength test could not be performed on Samples 1 through 5 because all of these samples were so elastic that the films and laminates did not rupture during the test and appeared not to be distorted after the test. The water vapor transfer rate of Sample 1 was rather good at 3380 g/m2/24 hours as was the hydrostatic head at 549 mm. The PBAT film containing 20% calcium carbonate (CaCO3) (Sample 2) had similar properties as Sample 1 with both the WVTR and hydrohead being a little lower. PBAT films similar to Samples 1 and 2 with a smaller thickness of 6 μm or less would also be expected to have good elongation and higher WVTR, although the hydrohead may be lower. The melt-blown (MB) Sample 3, containing 80% Vistamaxx® (Vistamaxx polyolefin-based polymer is highly elastic and is produced by ExxonMobil) and 20% PP had a very high MD and CD elongation of about 300% and a very high WVTR of 8816 g/m2/24 hours since the fabric is fairly open. Although the MB Vistamaxx fabric is not biodegradable, it is an example of an elastic nonwoven which could potentially be made from a biodegradable polymer, such as PBAT and other biodegradable polymers with very high elongation and recovery from deformation. The hydrohead of Sample 3 was rather high at 1043 mm, which indicated it still had good barrier properties. It should be noted that 20% PP was added to the Vistamaxx polymer pellets and physically mixed before the blend was fed into the MB extruder and melted so that the Vistamaxx MB fabric would not be too sticky. If 100% Vistamaxx was meltblown, it would be very sticky and may block on the roll and be difficult to un-wind for lamination or use later.

The lamination of the pure PBAT and PBAT containing 20% CaC03 with Vistamaxx using a hot-melt adhesive notably increased the MD and CD tenacity compared to Vistamaxx alone. The samples also had very high MB elongation and particularly high CD elongation (390% with Sample 4 and 542% with Sample 5). Also Samples 4 and 5 had notably high MVTR values of 1671 and 1189 g/m2/24 hours and high hydroheads of 339 and 926 mm H2O, respectively. Again it should be noted that the PBAT films could have been extrusion-coated directly onto MB 100% Vistamaxx or onto MB Vistamaxx with some PP with or without the use of a hot-melt adhesive and the extrusion-coating process could have allowed a much thinner gauge of PBAT film to be used, possibly as low as 4 or 5 with a resulting higher MVTR, but with possibly lower hydrohead.

The black SB PLA with a target weight of 80 g/m2, had a MD tenacity of 104 N and a CD tenacity of 31 N, but with a lower MD elongation-at-break of 3.6% but high CD elongation of 30.7%. The busting strength was 177 KN/m2 and the WVTR was rather high at 8322 g/m2/24 hours and the hydrohead was notable at 109 mm. The MD and CD tenacity of the 80 gsm black SB PLA, which was laminated to pure PBAT with hot-melt adhesive, were higher than with the SB PLA alone at 107 and 39 N, respectively, but the CD elongation was only 9.8%. However, the PBAT laminated SB PLA had higher burst strength at 220 KN/m2. The breathability was still good with a WVTR of 2459 g/m2/24 hours and a very high hydrohead of 3115 mm H2O. The SB PLA laminated with PBAT containing 20% CaCO3 had similar properties to Sample 8, except that the hydrohead, although still high at 2600 mm H2O, was lower. The lamination of SB PLA with thinner PBAT films, and especially with thinner PBAT films deposited by extrusion coating, produces protective apparel for medical, industrial or sports applications with high MVTR for wearing comfort and high hydrostatic head for barrier protection. The barrier protection could be further enhanced by the application of a repellent finish (fluorochemical silicone or other types of repellent finishes) to either the PBAT film side or to the SB PLA on either side before or after lamination with the film. Another enhancement would be the lamination of MB PLA with SB PLA before or after lamination with the film. The repellent finishing agent could also possibly be added to the polymer melt used to produce the PBAT film, SB or MB PLA, for example.

When two layers of SB PLA were melt-adhesively bonded together to produce Sample 9, the MD and CD tenacity and bursting strength were essentially twice one layer, Sample 6. The target MD and CD tenacity and corresponding elongation-to-break (% elongation) values of patient lifting slings produced from 110 g/m2 SB PP are at least 200 and 140 N/5 cm, respectively, with elongation values of at least 40% in both MD and CD. As shown in Table 1, the MD tenacity of the two adhered layers of SB PLA is 215 N but the CD tenacity is only about 50% of the required level. Also the MD and CD % elongation values are much lower than the required minimum of 40%. The MD and CD elongation of SB PLA can be improved by blending from 5 to 60% PBAT and preferably 20-50% PBAT with the PLA prior to extrusion of the SB fabrics. Furthermore, PBAT and PBS may be blended with PLA to achieve fabric with the desired MD and CD tenacity and elongation values, as well as stability to heat exposure. Furthermore, the SB filament web may be bonded by processes other than thermal point calendaring to achieve greater multi-directional strength and elongation to include hydroentanglement and needlepunching. Needlepunched SB PLA can be produced at weights or 110 g/m2 and greater without the need to laminate and bond two or more SB PLA fabrics together to achieve the required strength and elongation values.

In Table 2, two SB PLA fabrics are compared which are composed of 100% PLA and of a blend of 80% PLA and 20% PHB. It is shown that the blend of 80% PLA/20% PHB has substantially greater MD and CD tenacity and four times greater MD elongation and three times greater CD elongation than the 100% PLA SB. Laminating two layers of Sample 11 using melt adhesive as was done to produce Sample 9 in Table 1 should result in a fabric with very high MD and CD tensile strength and tearing strength and in higher elongation compared to Sample 9.

TABLE 2

Comparison of SB 100% PLA to SB 80% PLA/20% PHB

| Sample No./ | Weight | Tenacity (N) | | Elongation (%) | | Tearing Strength (N) | |
|---|---|---|---|---|---|---|---|
| Description | $g/m^2$ | MD | CD | MD | CD | MD | CD |
| 10/SB 100% PLA | 75.3 | 78.1 | 27.2 | 4.0 | 9.0 | 8.0 | 7.5 |
| 11/SB 80% PLA/20% PHB | 78.7 | 90.8 | 40.4 | 16.0 | 28.2 | 8.2 | 18.2 |

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A manual lifting sling apparatus, comprising:

a bottom support part used to support the buttocks and the legs of a patient;

a rear support part used to support the back of the patient, the rear support part connected to the bottom support part in a sloping angle;

a left blocking part and a right blocking part used to refine the patient at the left side and the right side respectively, the left blocking part and the right blocking part connected to both the bottom support part and the rear support part; and at least two lifting handles attached to each of the left blocking part and the right blocking part, wherein the bottom support part, rear support part, left blocking part, and right blocking part are each made of fabric, wherein a defined portion of the fabric surrounding the at least two lifting handles has a greater strength than a non-defined remainder portion of the fabric, wherein the defined portion of the fabric includes extrusion coated material;

the edges of the bottom support part, the rear support part, the left blocking part and the right blocking part are at least one of folded and reinforced and seamed to one piece;

the bottom support part and the rear support part are cut to conform to the body shape of the patient and provided with wrinkles;

wherein the edges of the bottom support part, the rear support part, the left blocking part and the right blocking part are each include edges that are seamed with thread or ultrasonically bonded.

2. The manual lifting sling apparatus of claim 1, wherein the fabric is at least one of woven and nonwoven fabric.

3. The manual lifting sling apparatus of claim 1, wherein the defined portion of the fabric includes material extrusion coated with a fabric film.

4. A method of preventing cross-infection between lifted patients, wherein each patient has his or her own dedicated manual lifting sling apparatus described in claim 1.

5. The manual lifting sling apparatus of claim 1, wherein the fabric is provided with a label.

6. The manual lifting sling apparatus of claim 1, wherein the fabric is made of at least one layer of woven or nonwoven film.

7. The manual lifting sling apparatus of claim 1, wherein a breathable non-biodegradable or biodegradable film is adhered to at least one face of the fabric.

8. The manual lifting sling apparatus of claim 1, wherein the fabric is made of non-biodegradable materials comprising at least one of PP, PE, PET and PA.

9. The manual lifting sling apparatus of claim 1, wherein the fabric is made of biodegradable materials comprising at least one of PLA, PHA, PHA, PBAT, PBS, and PHB.

10. The manual lifting sling apparatus of claim 1, wherein the fabric includes heat bonded randomly oriented non-biodegradable or biodegradable fibers.

11. The manual lifting sling apparatus of claim 1, wherein the fabric includes hydroentangled or needlepunched continuous filament or staple fiber webs.

12. The manual lifting sling apparatus of claim 1, wherein the fabric includes webs of continuous filaments or staple fibers bonded with non-biodegradable or biodegradable chemicals comprising latex binders or adhesives.

* * * * *